US006114077A

United States Patent [19]

Voets et al.

[11] Patent Number: 6,114,077

[45] Date of Patent: Sep. 5, 2000

[54] WHITE TONER COMPOSITION

[75] Inventors: Raphaël Voets, Hever; Serge Tavernier, Lint; Gerrit Delen, Herselt, all of Belgium

[73] Assignee: Agfa-Gevaert, N.V., Mortsel, Belgium

[21] Appl. No.: 09/345,777

[22] Filed: Jul. 1, 1999

Related U.S. Application Data

[60] Provisional application No. 60/101,036, Sep. 18, 1998, abandoned.

[30] Foreign Application Priority Data

Jul. 31, 1998 [EP] European Pat. Off. ..... 98202575

[51] Int. Cl.[7] ..... G03G 9/08

[52] U.S. Cl. ..... 430/110; 430/106.6; 430/13

[58] Field of Search ..... 430/106, 106.6, 430/108, 109, 13

[56] References Cited

U.S. PATENT DOCUMENTS

| | | | |
|---|---|---|---|
| 4,943,506 | 7/1990 | Demizu et al. . | |
| 5,077,158 | 12/1991 | Nakano . | |
| 5,225,300 | 7/1993 | Tsubota et al. | 430/106 |
| 5,905,011 | 5/1999 | Kurose et al. | 430/110 |

FOREIGN PATENT DOCUMENTS

| | | |
|---|---|---|
| 0 156 408 A1 | 10/1985 | European Pat. Off. . |
| 0 197 242 A2 | 10/1986 | European Pat. Off. . |
| 0 197 242 A3 | 10/1986 | European Pat. Off. . |
| 0 253 560 A1 | 1/1988 | European Pat. Off. . |
| 0 280 378 A2 | 8/1988 | European Pat. Off. . |
| 0 280 378 A3 | 8/1988 | European Pat. Off. . |

OTHER PUBLICATIONS

Derwent Publications, Ltd. (London, GB), Section Ch, Week 8914, Class E35, AN 89–102509, XP002088595 and JP 01 048067 A (Mita), Feb. 22, 1989.

Derwent Publications, Ltd. (London, GB), Section Ch, Week 9013, Class A12, AN 90–093679, XP002088596 and JP 02 043563 A (Fuji Xerox), Feb. 14, 1990.

*Primary Examiner*—John Goodrow
*Attorney, Agent, or Firm*—Breiner & Breiner

[57] ABSTRACT

A white toner composition comprising 100 parts by weight of a toner resin containing at least 50 parts by weight of a polyester resin and between 65 and 180 parts by weight of rutile type $TiO_2$, 10 g/m$^2$ of said non-magnetic toner particles deposited on a transparent foil giving an opacity (hiding power) of at least 60%.

23 Claims, No Drawings

WHITE TONER COMPOSITION

The application claims the benefit of U.S. Provisional Application No. 60/101,036 filed Sep. 18, 1998, abandoned.

FIELD OF THE INVENTION

This invention relates to dry non-magnetic toner particles comprising a white pigment, especially to dry non-magnetic toner particles comprising rutile type $TiO_2$. It further relates to a method for printing images on a transparent wherein the images contain a white background.

BACKGROUND OF THE INVENTION

White toner particles and their use is known in the art, especially for printing on a black background or for printing techniques wherein black and white toners are used for printing different gray levels.

In EP-A-253 560, an electrophotographic copying method is disclosed, comprising the use of a copying apparatus having a positive-image copying system, wherein toner images with a colored toner are formed and transferred to a colored insulating paper of a color different to that of said toner while selecting the colors of the paper and the toner so as to form reverse images. In an example a white toner with 100 parts by weight of a styrene-acrylic resin and 20 parts by weight of rutile type $TiO_2$ is disclosed.

In EP-A-280 378 a white toner is disclosed comprising a fixing resin and dispersed therein, a titanium dioxide pigment of high purity containing at least 99% by weight of $TiO_2$, not more than 0.1% by weight of $Al_2O_3$ and not more than 0.05% by weight of $SiO_2$ as a white pigment, said titanium dioxide having an average particle diameter of not less than 0.05 $\mu$m. In this disclosure it is stressed that good charging quality of the toner particles can not be reached when the $TiO_2$ is not that pure. It is said that maximum 50 parts by weight, preferably maximum 30 parts by weight, of the $TiO_2$ can be used for 100 parts by weight of toner resin because toner with higher amounts of $TiO_2$ can not be fixed.

In JP-A-01 048067 a white toner is disclosed wherein between 5 and 20% by weight of $TiO_2$ is present, preferably there is between 8 and 10% by weight of $TiO_2$.

In U.S. Pat. No. 4,943,506 a white toner is disclosed comprising binder resin and titanium dioxide with 0.20–0.35 $\mu$m in mean particle size at the content of 15–60 parts by weight on the basis of 100 parts by weight of the binder resin.

In U.S. Pat. No. 5,077,158, a process for forming an image is disclosed, which comprises developing an electrostatic latent image with a gray toner, wherein a mixture of a white toner and a black toner is used as the gray toner. The white toner comprises preferably $TiO_2$ in the rutile crystal structure and for at most 50 parts by weight for 100 parts by weight of toner resin.

Nowadays a well accepted way of printing labels is printing them with digital electrostatographic printing means, e.g. the CHROMAPRESS (trade name of Agfa-Gevaert NV, Mortsel, Belgium) or the DCP1 (trade name of Xeikon NV, Mortsel, Belgium). Also transparent labels are printed with such printing devices, and when opaque white images on a transparent support, it is preferred to have toner particles giving a high opacity, i.e. the hiding power of a layer of white toner must be very high. When a transparent self-adhesive label for application on a colored, e.g. red, background is printed with white lettering, it is desired that the lettering really shows white and not white with a faint red hue. Also when on a transparent label a bar-code has to be printed, it is desired for better readability of the bar-code that it is printed on a white background and then the white must be very opaque. The known toner particles are well suited for printing white images, but for printing for the printing of white images on transparent substrates, the hiding power has to be still higher.

OBJECTS AND SUMMARY OF THE INVENTION

It is an object of the invention to provide white non-magnetic toner particles with high hiding power, wherein $TiO_2$ particles are present and well mixed with the toner resin, that have good fixing properties and that give stable printing results in long time printing runs.

It is also an object of the invention to provide an electrostatographic method for printing white images with high hiding power on a transparent substrate.

TABLE 1

| Chemical structure | AV* | HV** | Tg ° C. | Mn+ | Mw† |
|---|---|---|---|---|---|
| 1. Polyester resin of terephthalic acid, ethyleneglycol and DIANOL 22 | 3 | 31.1 | 62 | 3.6 | 10 |
| 2. Polyester resin of fumaric acid and DIANOL 33 | 17 | 5.2 | 55 | 4.4 | 12 |
| 3. Polyester resin of terephthalic acid, isophthalic acid and DIANOL 22 and ethyleneglycol | 18 | 20.9 | 60 | 4 | 18 |
| 4. Polyester resin of DIANOL 33/ DIANOL 22, terephthalic acid and trimellitic acid | 30 | 50 | 65 | 2.0 | 14 |
| 5. Polyester resin of DIANOL 33, iosphthalic acid and adipic acid | 16 | na | 58 | 4.1 | 9.7 |

*AV: acid value in mg KOH/g resin
**HV: hydroxyl value in mg KOH/g resin
+Mn: numerical average molecular weight (× 1000)
†Mw: weight average molecular weight (× 1000)
DIANOL 22 is a trade name of AKZO CHEMIE of the Netherlands for bis-ethoxylated 2,2-bis(4-hydroxyphenyl)propane.
DIANOL 33 is a trade name of AKZO CHEMIE of the Netherlands for bis-propoxylated 2,2-bis(4-hydroxyphenyl)propane.
na: not available It proved that from the white pigments known in the art, (e.g. $BaSO_4$, ZnO, $TiO_2$, etc), $TiO_2$ in rutile crystal configuration was the most efficient. The titanium dioxide useful in this invention does not need to be for at least 99% pure, although rutile type $TiO_2$ with a purity of 99% and up can be used in this invention, it is also possible to use $TiO_2$ with a purity between 94% and 98%, this means that $TiO_2$ wherein $Al_2O_3$ and/or $SiO_2$ are present in a relative high amount is also useful in non-magnetic toner particles according with high opacity or high hiding power (i.e. an opacity of at least 60%) even when only between 0.75 mg and 1.5 mg/cm$^2$ (7.5 g/m$^2$ and 15 g/m$^2$) non-magnetic toner particles are deposited. It showed possible to produce white non-magnetic toner particles according to this invention, giving an opacity of at least 60% when between 0.9 mg and 1.1 mg/cm$^2$ (9 g/m$^2$ and 11 g/m$^2$) of toner particles were deposited.

Opacity or hiding power of a white image was measured by applying the white toner particles on a transparent support forming an image of even patch of white density, placing said image on a light trap and measuring, in reflectance mode, the opacity $OP1=I_{reflBL}/I_0$, the opacity being the ratio of the reflected light intensity over the intensity of the light irradiated on the white image. Then the same white image is placed over a white tile and again in reflectance mode, the opacity $OP2=I_{reflWH}/I_0$ is measured. In both measurements $I_0$ is the same. The opacity or in fact the hiding power of the white image is determined by the ratio $(OP1/OP2)\times100=OP=(I_{reflBL}/I_{reflWH})\times100$. The larger OP the higher the hiding power.

It was found that the toner resin could be any resin know in the art as long as for 100 parts (wt/wt) of toner resin at least 50 parts (wt/wt) of a polyester was present. Preferably the toner resin in non-magnetic toner particles according to this invention contains a least 50 parts (wt/wt) of a polyester with acid or hydroxyl value between 10 and 30 mg KOH/g. More preferably the toner resin in non-magnetic toner particles according to this invention is a polyester or a mixture of different polyesters. In that case, it is preferred to use a polyester with acid or hydroxyl value between 10 and 30 mg KOH/g or when a mixture of different polyesters is used to include in that mixture at least 50% (wt/wt) of a polyester with acid or hydroxyl value between 10 and 30 mg KOH/g. Very useful polyester resins for use in non-magnetic toner particles according to this invention are tabulated in table 1.

Further objects and advantages of the invention will become clear from the detailed description hereinafter.

The object of the invention is realized by providing non-magnetic toner particles comprising 100 parts by weight of toner resin, wherein at least 50 parts by weight of said toner resin is a polyester resin and between 65 and 180 parts by weight of rutile type $TiO_2$ for 100 parts by weight of said toner resin.

The further object of the invention is realized by providing an electrostatographic printing method for white toner images with an opacity, OP, of at least 60% comprising the steps of:

image-wise applying between 7.5 g/m$^2$ and 15 g/m$^2$ of white non-magnetic toner particles containing a toner resin and a white pigment on a substrate and fixing said non-magnetic toner particles on said substrate, characterized in that, said non-magnetic toner particles comprise 100 parts by weight of toner resin, wherein at least 50 parts by weight of said toner resin is a polyester resin and between 65 and 180 parts by weight of rutile type $TiO_2$ for 100 parts by weight of said toner resin.

DETAILED DESCRIPTION OF THE INVENTION

It was, surprisingly, found that it was possible to prepare non-magnetic toner particles with from 65 to 180 parts by weight of rutile type $TiO_2$ for 100 parts by weight of toner resin, when said toner resin comprised at least 50 parts by weight of a polyester resin, although the prior art teachings indicate that not more than 60 parts by weight of rutile type $TiO_2$ for 100 parts by weight of toner resin could be incorporated in toner particles. No problems were with respect to stability of the toner charge, to the fixing properties were observed, even not when the rutile type $TiO_2$ was only between 95 and 98% pure. Both in fixing system where the fixing proceeded by hot-roller fixing as in a system where the fixing proceeds by non-contact means, especially by infra-red radiation, the fixing quality of the toner image was good despite the high pigment to resin ratio.

This finding opens the way to the possibility of producing non-magnetic toner particles that can be used for producing white image to this invention. This has the advantage that for producing non-magnetic toner particles of this invention also less pure and thus less expensive $TiO_2$ can be used. The non-magnetic toner particles according to this invention comprising $TiO_2$ in rutile crystal configuration can further comprise $SiO_2$ or $Al_2O_3$ that is deliberately added to the $TiO_2$. These compounds can be added to the mixture of toner resin and $TiO_2$, during the melt kneading step in the production of the non-magnetic toner particles, or can first be mixed to fix the $SiO_2$ or $Al_2O_3$ on the surface of the $TiO_2$. Such treatments of the $TiO_2$ have been described in U.S. Pat. No. 4,943,506.

The surface of the $TiO_2$ for use in toner particles according to this invention can also, before adding it to the bulk of the toner particles, be treated by an organic compounds selected from the group of silicone oils, silane coupling agent, titanium coupling agents aluminum coupling agents and zirco-aluminum coupling agents.

Typical useful silane coupling agents are, e.g., vinyl triacetoxy silane, methyl trimethoxy silane, vinyl tris (methoxyethoxysilane), methyl triethoxysilane, etc.. Useful titane coupling agents are, e.g., isopropyl triisostearoyl titanate, isopropyl trioctanoyl titanate, etc.. A typical useful aluminum coupling agent is, e.g., acetoalkoxy aluminum di-isopropylate. Examples of rutile type $TiO_2$ commercially available and useful in non-magnetic toner particles of this invention are, e.g., BAYERTITAN RKB2 and BAYERTITAN RDFI (trade names of Bayer AG, Leverkusen, Germany) or RHODITAN RL60 and RHODITAN RL67 (trade names of Rhone-Poulenc, France). From these commercial available rutile type $TiO_2$ it is preferred to use BAYERTITAN RDFI.

Toner particles according to this invention can also comprise fluorescent brightening agents, that fluoresce under UV-light. By adding such fluorescent brightening agents, the whiteness of an image printed with white non-magnetic toner particles of this invention is enhanced. Typical useful fluorescent brightening agents are, e.g.,

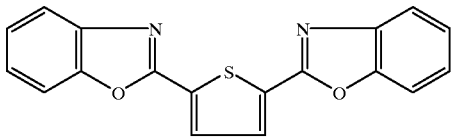

sold by Ciba-Geigy, Switserland under trade name UVITEX OKF,

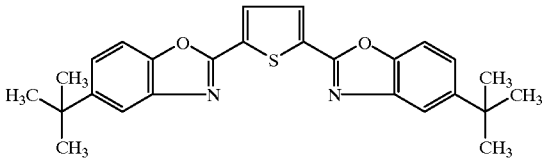

sold by Ciba-Geigy, Switserland under trade name UVITEX OB, or derivatives of stilbene.

The addition of fluorescent brightening agents to enhance the whiteness of a toner according to this invention has advantages over the addition of blue coloring agents. A image made with white toner of this invention with a fluorescent brightening agent does not show a bluish hue and can thus be used in relative high concentration, i.e. up to 10 parts (wt/wt) for 100 parts (wt/wt) of toner resin. Preferably an amount between 1 and 5 parts (wt/wt) for 100 parts (wt/wt) of toner resin is used.

White toner particles comprising a fluorescent brightening agent are very useful in security printing. With such toners an image can be printed on white paper, white polymeric image receiving sheets without fluorescent brightening agent. Such an image is almost invisible under normal ambient lightening conditions, but becomes clearly visible under UV-light. It is also possible to print a first white image on a colored background with toner particles of this invention that do not contain a fluorescent brightening agent and another image (near to said first image or on top of it) with non-magnetic toner particles of this invention that do contain a fluorescent brightening agent. In this case the first image is visible under normal ambient lightening conditions and the second becomes visible under UV-illumination. Thus it is possible to add in the print a kind of "ghost image" that is only visible under UV (ultraviolet) illumination. Such a feature adds to the security of, e.g., identity documents.

Toner particles according to this invention can, even without the presence of a fluorescent brightening agent, be used for including security features in printed matter. It is possible to print on a transparent support (mostly a polymeric support) an even white background with toner particles according to this invention wherein a white image with different opacity (from slightly, i.e. less than 1% different up to 25% different) is present. The image of different density can be printed by applying a higher or lower amount of toner particles than the amount of toner particles used to print the background density. In this case the same toner particles can be used. The image of different density can be printed by applying toner particles containing a lower amount of $TiO_2$ than the amount of $TiO_2$ present in the toner particles used to print the background density. In reflection mode such a white background looks as having an even density, but in transmission the image with lower white opacity is easily seen such that a kind of "watermark" is introduced. The white background can then be used for printing any image by any other printing means. It is evident that the methods of including security features as described above using white toner particles not having a fluorescent brightening agent can be combined with methods wherein white toner particles having a fluorescent brightening agent are used.

Toner particles according to this invention can further comprise waxes, especially useful waxes are monohydroxy compounds with formula $CH_3(CH_2)_nOH$ wherein n is an integer between 21 and 360 or monocarboxy compounds with formula $CH_3(CH_2)_nCOOH$ wherein n is an integer between 21 and 360. Such compounds are available under trade name UNICID for the monocarboxy compounds and UNILIN for the monohydroxy compounds from PETROLITE, 6910 East 14th street, TULSA, Okla. 74112, USA. Also onium compounds having an alkylgroup of at least 12 C-atoms and at most 25 C-atoms can be added to the non-magnetic toner particles of this invention. Such an onium compound is beneficial as charge control agent and, as disclosed in U.S. Pat. No. 5,622,803 and U.S. Pat. No. 5,532,097 for giving the toner particles a narrow charge distribution. A typical member of the class of useful onium compounds for incorporation in toner particles of this invention is $(CH_3)_3N^+C_{16}H_{33}$ $Br^-$ It was moreover found that, although the $TiO_2$ could be well dispersed in a toner resin as long as for 100 parts (wt/wt) of toner resin at least 50 parts (wt/wt) of a polyester was present, the dispersion of the $TiO_2$ was still better when either a monohydroxy compound with formula $CH_3(CH_2)_nOH$ wherein n is an integer between 21 and 360, a monocarboxy compound with formula $CH_3(CH_2)_nCOOH$ wherein n is an integer between 21 and 360 or an onium compound having an alkylgroup of at least 12 C-atoms and at most 25 C-atoms was present.

Toner particles according to this invention are preferably used in a non-magnetic mono-component developer or in a two component developer wherein the non-magnetic toner particles are used together with magnetic carrier particles. The use of the non-magnetic toner particles of this invention in a two-component developer is most preferred and the non-magnetic toner particles comprise at least one resistivity lowering substance compound having a volume resistivity lower than the volume resistivity of said resin, wherein said substance is capable of lowering the volume resistivity of said resin by a factor of at least 3.3 when present in said resin in a concentration of 5% by weight relative to the weight of said resin. The non-magnetic toner particles have preferably an absolute median $|q/d|$ charge/diameter value lower than 10 fC/10 $\mu$m but not lower than 1 fC/10 $\mu$m, the distribution of the charge/diameter values of the individual non-magnetic toner particles is has by a coefficient of variation $\eta \leqq 0.33$.

Although the white toner particles of this invention can be used with any kind of magnetic carrier particles known in the art, e.g. iron beads, composite carriers, etc, with an average particles diameter from 10 to 200 $\mu$m, it is preferred to use the white non-magnetic toner particles of this invention in a developer comprising magnetic carrier particles said carrier particles having:

a saturation magnetization value, $M_{sat}$, expressed in Tesla (T) such that $M_{sat}>0.30$ T a volume average particle size ($C_{avg}$) such that 30 $\mu m<C_{avg}<60$ $\mu$m a volume based particle size distribution so that at least 90% of the particles having a particle diameter C such that $0.5C_{avg}<C<2C_{avg}$ a volume based particles size distribution having less than b % particles smaller than 25 mm wherein $b=0.35\times(M_{sat})$ $2\times P$ wherein $M_{sat}$=saturation magnetization value expressed in T and P=the maximal field strength of the magnetic developing pole expressed in kA/m a core particle coated with a silicone resin coating in an amount (RC) such that 0.2% wt/wt<RC<2% wt/wt.

The present invention also encompasses a method for producing white toner images with an opacity, OP, of at least 60% comprising the steps of:

image-wise applying between 7.5 g/m$^2$ and 15 g/m$^2$ of white non-magnetic toner particles containing a toner resin and a white pigment on a substrate and fixing said non-magnetic toner particles on said substrate, characterized in that, said toner particles comprise 100 parts by weight of toner resin, wherein at least 50 parts by weight of said toner resin is a polyester resin and between 65 and 180 parts by weight of rutile type $TiO_2$ for 100 parts by weight of said toner resin.

The present invention also encompasses a method for including security features to a toner image comprising the steps of applying a toner image to a white, non fluorescent, substrate, applying an image of white non-magnetic toner particles comprising 100 parts by weight of toner resin, wherein at least 50 parts by weight of said toner resin is a polyester resin and between 65 and 180 parts by weight of rutile type $TiO_2$ for 100 parts by weight of said toner resin and between 0.5 and 5 parts (wt/wt) for 100 parts by weight of said toner resin of a fluorescent brightening agent and fixing the images to said substrate.

The invention also comprises a method for including security features to a toner image comprising the steps of applying on a substrate an image of white non-magnetic toner particles comprising 100 parts by weight of toner resin, wherein at least 50 parts by weight of said toner resin is a polyester resin and between 65 and 180 parts by weight of rutile type $TiO_2$ for 100 parts by weight of said toner resin and wherein no fluorescent brightening agent is present, applying on said substrate an image of white non-magnetic toner particles comprising 100 parts by weight of toner resin, wherein at least 50 parts by weight of said toner resin is a polyester resin and between 65 and 180 parts by weight of rutile type $TiO_2$ for 100 parts by weight of said toner resin and between 0.5 and 5 parts (wt/wt) for 100 parts by weight of said toner resin of a fluorescent brightening agent and fixing said toner image to said substrate.

The invention further encompasses a method for including security features to a toner image comprising the steps of applying in a single step on a transparent support a white image with opacity (OP3) by depositing an amount, A g/m$^2$, of white toner particles according to this invention not containing a fluorescent brightener, applying an even white background with opacity (OP4) around said image by depositing an amount, B g/m$^2$, of white toner particles according to this invention not containing a fluorescent brightener, so that the amount B is different from said amount A, for forming an image that is invisible in reflection mode and visible in transmission mode and fixing said image to said support.

The invention further encompasses a method for including security features to a toner image comprising the steps of applying on a transparent support a white image with opacity (OP3) by depositing an amount, A g/m$^2$, of white toner particles according to this invention not containing a fluorescent brightener and containing an amount C parts of $TiO_2$ per 100 parts of toner resin, applying an even white background with opacity (OP4) around said image by depositing an amount, A g/m$^2$, of white toner particles according to this invention not containing a fluorescent brightener, and containing an amount D parts of $TiO_2$ per 100 parts of toner resin, so that the amount D is different from said amount C, for forming an image that is invisible in reflection mode and visible in transmission mode and fixing said image to said support.

EXAMPLES

Preparation of the Toner Particles 50 parts of resin No. 3 of Table 1 and 50 parts of resin No. 5 of Table 1 as were melt-blended for 30 minutes at 110° C. in a laboratory kneader with various amounts of $TiO_2$.

After cooling the solidified mass was pulverized and milled using an ALPINE Fliessbettgegenstrahlmühle type 100AFG (trade name) and further classified using an ALPINE multiplex zig-zag classifier type 100MZR (trade name). The average particle size of the separated toner was measured by COULTER COUNTER MODEL MULTISIZER (trade name) was found to be 8.0 μm by volume.

To improve the flowability of the toner mass the toner particles were mixed with 0.5% of hydrophobic colloidal silica particles (BET-value 130 m$^2$/g) to give a toner composition.

Twelve different types of toner particles (T1 to T12) were prepared, the amount, the nature and the manufacturer of $TiO_2$ added to the toner particles are tabulated in table 2.

Developers

A Cu—Zn ferrite based coated carrier was prepared by coating a Cu—Zn ferrite core with 1% of dimethylsilicone using a solution spraying technique in a fluidized bed and post curing the coating. The carrier showed a saturation magnetization ($M_{sat}$) of 0.41 T. The particle size distribution was characterized by:

$$d_{v50\%}=52.5\ \mu m,\ d_{v10\%}=32\ \mu m \text{ and } d_{v90\%}=65\ \mu m.$$

The amount of particles <25 μm was 4.9% wt/wt.

A developer was prepared by adding 7.5% of the toner compositions to the carrier particles.

PRINTING EXAMPLES

The thus obtained developers were used separately in an X-35 (trade name of Agfa-Gevaert N.V.) electrophotographic copier wherein the photoconductive drum was evenly exposed forming a latent image, the latent image was developed with one of the developers containing the toner particles described above and wherein the image was transferred on one side of a transparent support PROPYLUX type 60064 (trade name) a label material available from Jackstädt GmbH, Wuppertal, Germany.

From said X-35 copier the standard hot roller fuser was removed, and the toner of the unfixed copy was non-contact fused by radiation using an infra-red black body radiant element placed at a distance of 10 mm from the transparent support carrying the toner image. The support passed by the radiant element at a speed of 5 cm per second. The average power provided to the radiant heating element was 375 W making the element operate at a temperature of 600° C. using reflectors to concentrate the radiant heat onto the support.

With each of the developers four different patches of even white density, but with differing opacity, were printed by applying different amounts of toner particles, ranging from 5 g/m$^2$ to 15 g/m$^2$. For each of these patches the opacity was measured as described above. By interpolation the opacity reached by applying 10 g/m2 (1 mg/cm$^2$) of white toner particles were determined. The values are also tabulated in table 2.

TABLE 2

| # | Parts (wt/wt) $TiO_2$ for 100 parts of toner resin | Type* | Trade name | Opacity in % for 10 g/m2 deposited toner particles |
|---|---|---|---|---|
| 1 | 25 | A | KRONOS A | 48 |
| 2 | 67 | A | KRONOS A | 56 |
| 3 | 150 | A | RHODITAN AT1 | 51 |
| 4 | 67 | R | BAYERTITAN RKB2 | 60 |
| 5 | 150 | R | BAYERTITAN RKB2 | 62 |
| 6 | 150 | R | RHODITAN RL60 | 61 |
| 7 | 150 | R | RHODITAN RL67 | 61 |
| 8 | 67 | R | BAYERTITAN RDFI | 62 |
| 9 | 83 | R | BAYERTITAN RDFI | 65 |
| 10 | 150 | R | BAYERTITAN RDFI | 68 |
| 11 | 25 | R | BAYERTITAN RDFI | 44 |
| 12 | 60 | R | BAYERTITAN RDFI | 57 |

*Type: A = anataas, R = rutile
KRONOS A: trade name of Kronos NV, Brussel, Belgium
RHODITAN: trade name of Rhone-Poulenc, France
BAYERTITAN: trade name of Bayer AG, Leverkusen Germany

What is claimed is:

1. Dry non-magnetic toner particles comprising a toner resin, wherein at least 50 parts by weight of said toner resin is a polyester resin and between 65 and 180 parts by weight of rutile type $TiO_2$ for 100 parts by weight of said toner resin.

2. Dry non-magnetic toner particles according to claim 1, wherein said toner resin is a polyester.

3. Dry non-magnetic toner particles according to claim 1 wherein said polyester is a polyester having an acid value between 10 and 30 mg KOH/g of polyester.

4. Dry non-magnetic toner particles according to claim 1, wherein said rutile type $TiO_2$ has a purity between 94 and 98%.

5. Dry non-magnetic toner particles according to claim 1, further comprising a fluorescent brightening agent.

6. Dry non-magnetic toner particles according to claim 1, further comprising a compound selected from the group consisting of monohydroxy compounds with formula $CH_3(CH_2)_nOH$ wherein n is an integer between 21 and 360, monocarboxy compounds with formula $CH_3(CH_2)_nCOOH$ wherein n is an integer between 21 and 360 and onium compounds having an alkylgroup of at least 12 C-atoms and at most 25 C-atoms.

7. Dry non-magnetic toner particles according to claim 2 wherein said polyester is a polyester having an acid value between 10 and 30 mg KOH/g of polyester.

8. Dry non-magnetic toner particles according to claim 2, wherein said rutile type $TiO_2$ has a purity between 94 and 98%.

9. Dry non-magnetic toner particles according to claim 2, further comprising a fluorescent brightening agent.

10. Dry non-magnetic toner particles according to claim 2, further comprising a compound selected from the group consisting of monohydroxy compounds with formula $CH_3(CH_2)_nOH$ wherein n is an integer between 21 and 360, monocarboxy compounds with formula $CH_3(CH_2)_nCOOH$ wherein n is an integer between 21 and 360 and onium compounds having an alkylgroup of at least 12 C-atoms and at most 25 C-atoms.

11. Dry non-magnetic toner particles according to claim 3, wherein said rutile type $TiO_2$ has a purity between 94 and 98%.

12. Dry non-magnetic toner particles according to claim 3, further comprising a fluorescent brightening agent.

13. Dry non-magnetic toner particles according to claim 3, further comprising a compound selected from the group consisting of monohydroxy compounds with formula $CH_3(CH_2)_nOH$ wherein n is an integer between 21 and 360, monocarboxy compounds with formula $CH_3(CH_2)_nCOOH$ wherein n is an integer between 21 and 360 and onium compounds having an alkylgroup of at least 12 C-atoms and at most 25 C-atoms.

14. A two component developer containing magnetic carrier particles and dry non-magnetic toner particles according to claim 1.

15. A two component developer containing magnetic carrier particles and dry non-magnetic toner particles according to claim 2.

16. A two component developer containing magnetic carrier particles and dry non-magnetic toner particles according to claim 9.

17. A two component developer containing magnetic carrier particles and dry non-magnetic toner particles according to claim 10.

18. An electrostatographic printing method for white toner images with an opacity, OP, of at least 60% comprising the steps of:

image-wise applying between 7.5 g/m$^2$ and 15 g/m$^2$ of white non-magnetic toner particles containing a toner resin and a white pigment on a substrate and fixing said non-magnetic toner particles on said substrate, characterized in that, said toner particles comprise a toner resin, wherein at least 50 parts by weight of said toner resin is a polyester resin and between 65 and 180 parts by weight of rutile type $TiO_2$ for 100 parts by weight of said toner resin.

19. A method according to claim 9, wherein said toner particles are deposited in an amount 9 g/m$^2$ and 11 g/m$^2$.

20. A method for including security features to a toner image comprising the steps of:

applying a toner image to a white, non fluorescent, substrate, applying an image of white non-magnetic toner particles comprising:

a toner resin, wherein at least 50 parts by weight of said toner resin is a polyester resin, between 65 and 180 parts by weight of rutile type $TiO_2$ for 100 parts by weight of said toner resin and between 0.5 and 5 parts (wt/wt) for 100 parts by weight of said toner resin of a fluorescent brightening agent and fixing the images to said substrate.

21. A method for including security features to a toner image comprising the steps of applying on a substrate an image of white non-magnetic toner particles comprising a toner resin, wherein at least 50 parts by weight of said toner resin is a polyester resin, between 65 and 180 parts by weight of rutile type $TiO_2$ for 100 parts by weight of said toner resin and wherein no fluorescent brightening agent is present, applying on said substrate an image of white non-magnetic toner particles comprising:

a toner resin, wherein at least 50 parts by weight of said toner resin is a polyester resin, between 65 and 180 parts by weight of rutile type $TiO_2$ for 100 parts by weight of said toner resin and between 0.5 and 5 parts (wt/wt) for 100 parts by weight of said toner resin of a fluorescent brightening agent and fixing said toner image to said substrate.

22. A method for including security features to a toner image comprising the steps of:

applying in a single step on a transparent support a white image with opacity (OP3) by depositing an amount, A g/m2, of white toner particles comprising a toner resin, wherein at least 50 parts by weight of said toner resin is a polyester resin, between 65 and 180 parts by weight of rutile type $TiO_2$ for 100 parts by weight of said toner resin and wherein no fluorescent brightening agent is present, applying an even white background with opacity (OP4) around said image by depositing an amount, B g/m2, of white toner comprising a toner resin, wherein at least 50 parts by weight of said toner resin is a polyester resin, between 65 and 180 parts by weight of rutile type $TiO_2$ for 100 parts by weight of said toner resin and wherein no fluorescent brightening agent is present, so that said amount B is different from said amount A, for forming an image that is invisible in reflection mode and visible in transmission mode and fixing said image to said support.

23. A method for including security features to a toner image comprising the steps of:

applying on a transparent support a white image with opacity (OP3) by depositing an amount, A g/m2, of white toner particles comprising a toner resin, wherein at least 50 parts by weight of said toner resin is a polyester resin, C parts by weight of rutile type $TiO_2$ for 100 parts by weight of said toner resin and wherein no fluorescent brightening agent is present, applying an even white background with opacity (OP4) around said image by depositing an amount, A g/m2, of white toner particles comprising a toner resin, wherein at least 50 parts by weight of said toner resin is a polyester resin, D parts by weight of rutile type $TiO_2$ for 100 parts by weight of said toner resin and wherein no fluorescent brightening agent is present, so that the amount D is different from said amount C, for forming an image that is invisible in reflection mode and visible in transmission mode and fixing said image to said support.

* * * * *